US006382685B1

(12) United States Patent
Hammond

(10) Patent No.: US 6,382,685 B1
(45) Date of Patent: May 7, 2002

(54) SLIDING CATCH WITH A PARTITION RELEASE ASSEMBLY

(75) Inventor: Leonard G. Hammond, Etobicoke (CA)

(73) Assignee: 3562042 Canada Inc., Oakville (CA)

( * ) Notice: Subject to any disclaimer, the term of this patent is extended or adjusted under 35 U.S.C. 154(b) by 0 days.

(21) Appl. No.: 09/429,285

(22) Filed: Oct. 28, 1999

Related U.S. Application Data

(60) Provisional application No. 60/106,386, filed on Oct. 28, 1998.

(51) Int. Cl.[7] ..... E05C 1/04

(52) U.S. Cl. ..... 292/145; 292/341.15; 292/341.18; 292/341.19; 292/92; 292/93; 49/13; 49/141; 49/394; 49/449; 49/50; 49/57

(58) Field of Search ..... 292/341.15, 341.18, 292/341.19, 92, 93, DIG. 65, 145; 49/141, 394, 449, 50, 57, 13

(56) References Cited

U.S. PATENT DOCUMENTS 3,698,751 A * 10/1972 Moore ..... 292/264
4,034,697 A * 7/1977 Russell ..... 116/100
4,380,269 A * 4/1983 Petaway ..... 169/51
4,503,582 A * 3/1985 Gurubatham ..... 16/232
4,598,893 A * 7/1986 Stobbart ..... 248/548
4,903,513 A * 2/1990 Stobbart ..... 70/422
5,237,775 A * 8/1993 Hardy ..... 49/181
5,249,510 A * 10/1993 Rozak ..... 99/336
5,638,906 A * 6/1997 McCabe ..... 169/51
6,073,978 A * 6/2000 Sherman ..... 292/80
6,124,796 A * 9/2000 Hincher ..... 340/628

* cited by examiner

*Primary Examiner*—Anthony Knight
*Assistant Examiner*—Matthew E. Rodgers
(74) *Attorney, Agent, or Firm*—Eugene J. A. Gierczak

(57) ABSTRACT

A sliding catch with partition release assembly for a fire extinguisher cabinet having a locking mechanism that comprises of a L-shaped member that has a first portion and a second portion that is defined as a stopping mechanism and a slotting mechanism. The slotting mechanism may be moved from a first locked position to a second unlocked position thereby releasing the locking mechanism and allowing the fire extinguisher cabinet to open. A partition release assembly allows for the injury-free access to the fire extinguisher cabinet by a fire-person.

16 Claims, 6 Drawing Sheets

SLIDING CATCH WITH A PARTITION RELEASE ASSEMBLY

This Appln claims benefit of Prov. No. 60/106,386 filed Oct. 28, 1998

FIELD OF INVENTION

This invention relates generally to a closure fastener, and specifically a sliding catch and a partition release assembly for use with a cabinet such as a fire extinguisher cabinet.

BACKGROUND OF INVENTION

Locked cabinets containing fire extinguisher equipment are often required in high-rise apartment buildings so that the fire extinguisher equipment is not stolen. In the case of a fire emergency, there are two options on how to get at the fire extinguisher and assorted equipment. The first is to find someone who has the key to the locked cabinet and unlock it, and the second is to break the partition or glass and reach in and try to unlock the cabinet. The first option presents problems as inevitably, the person with the key is not to be found forcing the fire-person to resort to the second option.

However there are problems with the second option as most of the locking mechanisms on the cabinets are bar locks that can not be easily moved when the partition or glass is broken, therefore the cabinet door remains locked and the fire person must try and access the equipment through the broken partition door which can sometimes result in injury.

Prior art fasteners have been devised to address some of the aforenoted problems. For example, U.S. Pat. No. 4,159,838 issued to Wilzig et al on Jul. 3, 1979, relates to a door latch bolt locking device for use with a latch bolt having a transverse groove or kerf in its top surface and which will positively prevent the withdrawal of the latch bolt. The device comprises a slidable member adapted to be substantially flush with the intersecting edge surface of the door and the inner surface of the door.

The slidable member will have a first portion which will be substantially flush with the inner surface of the door and an integral tongue portion at a right angle to the flat portion and adapted to be substantially flush with the edge surface of the door. The locking device is also provided with means for allowing the slidable member to be moved through a limited vertical distance in a substantially flush relationship with the door surfaces so that the tongue member can move into and out of the kerf provided in the latch bolt to thereby lock the door.

Charles J. Blackburn is the owner of U.S. Pat. No. 590,818 which issued on Sep. 28, 1897. This patent relates to a combined lock and catch consisting of a suitable casing; a bolt provided with an extended shank terminating in a catch; a shaft seated in said shank and catch and adapted to have a longitudinal movement therein, the hook on said shaft being adapted to hold said catch in engagement with its keeper.

U.S. Pat. No. 373,986 issued to J. B. Kelly on Nov. 29, 1887. This patent relates to a blind fastening and has for its object to provide a device of simple and cheap construction whereby the blinds may be held closed in a convenient manner, both when the window is raised and when closed, and wherein said window is closed the blinds cannot be opened from the outside.

U.S. Pat. No. 618,995 was issued on Feb. 7, 1899 to E. Praeger. This patent relates to a blind-fastener, the combination with a blind, of a window-sill bar, an attaching plate, an adjustable bar carried by the window-sill bar, and a hasp pivoted to the adjustable bar, whereby the device may be locked.

Walter F. Lee is the owner of U.S. Pat. No. 4,226,101 which issued on Oct. 7, 1980. This patent relates to an improvement in a lock for a cabinet for such items as, a fire extinguisher, tools, drugs, telephone, liquor, first aid and the like and more particularly to a lock which allows for opening of a locked door of a cabinet by a person requiring the contents of the cabinet but without a key for the lock. The lock is mounted on the casing of the cabinet and has a latch for engagement with the door which prevents the door from being opened. The lock includes a latch which is operable with a key or by means of breaking a frangible plate which allows access to a plush plate which when pushed inwardly of the lock causes the latch to be removed from the door whereby the lock can be unlocked without the key to allow opening of the door of the cabinet.

Thus a sliding catch with an improved ability to open the locked cabinet door of a fire cabinet is desirable when the bar lock is in the locked position. An improved partition release assembly that allows the user to enter the fire extinguisher cabinet without injury is also desirable.

SUMMARY OF THE INVENTION

The object of one aspect of the invention is to provide an improved sliding catch for a fire extinguisher cabinet having a partition release assembly.

In accordance with one aspect of the invention, there is provided a sliding catch with a partition release assembly for a fire extinguisher cabinet having a locking mechanism that comprises of a L-shaped member. The L-shaped member may have a first portion and a second portion. The second portion may further comprise of a stopping means and a slotting means. The slotting means may be moved from a first locked position to a second unlocked position.

The sliding catch is mounted to the fire extinguisher cabinet at the second portion. The stopping means contacts the locking mechanism of the fire cabinet when the slotting means is in the first locked position. The slotting means may be moved from the first locked position to the second unlocked position by lifting the first portion.

In accordance with still another aspect of the invention, the first portion may further comprise of a handle that a user may grasp when moving the slotting means from the first locked position to a second unlocked position.

In accordance with a further aspect of the invention, there is provided a sliding catch with a partition release assembly. The partition release assembly may comprise of a partition secured to the fire extinguisher cabinet by an angled release groove and indicator means. A cable may be connected at one end to the partition, and at the other end to the fire extinguisher cabinet frame itself.

Advantages of the present invention include the ability to open the fire extinguisher cabinet when the locking mechanism is in the locked position. Another advantage is the avoidance of injury to the user as the partition release assembly allows the user to push the partition into the cabinet and access the sliding catch without having to deal with the jagged edges of broken glass as experienced with conventional fire extinguisher cabinets.

BRIEF DESCRIPTION OF DRAWINGS

A detailed description of the preferred embodiment is provided herein below by way of example only with reference to the following drawings in which.

Figure 1A:
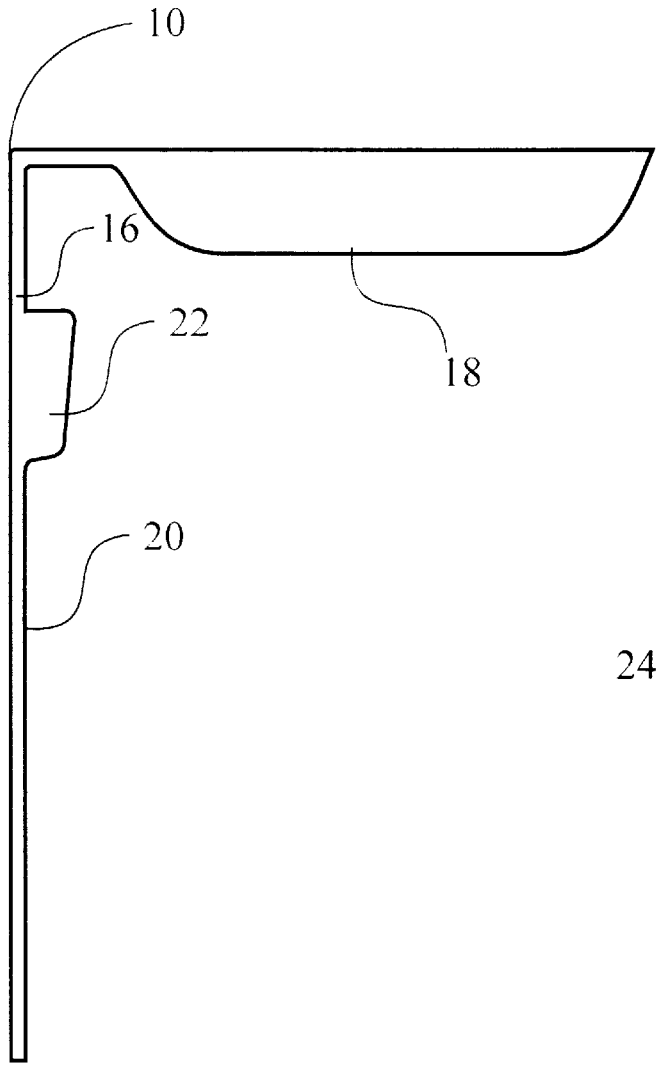
FIG. 1*a*, in a side view, illustrates a sliding catch in accordance with the preferred embodiment of the present invention.

In the drawings, preferred embodiments of the invention are illustrated by way of example. It is to be expressly understood that the description and drawings are only for the purpose of illustration and as an aid to understanding and are not intended as a definition of the limits of the invention.

BEST MODE FOR CARRYING OUT THE INVENTION

In the description which follows, like parts are marked throughout the specification and the drawings with the same respective reference numerals. The drawings are not necessarily to scale and in some instances proportions may have been exaggerated in order to more clearly depict certain features of the invention.

Figure 1B:
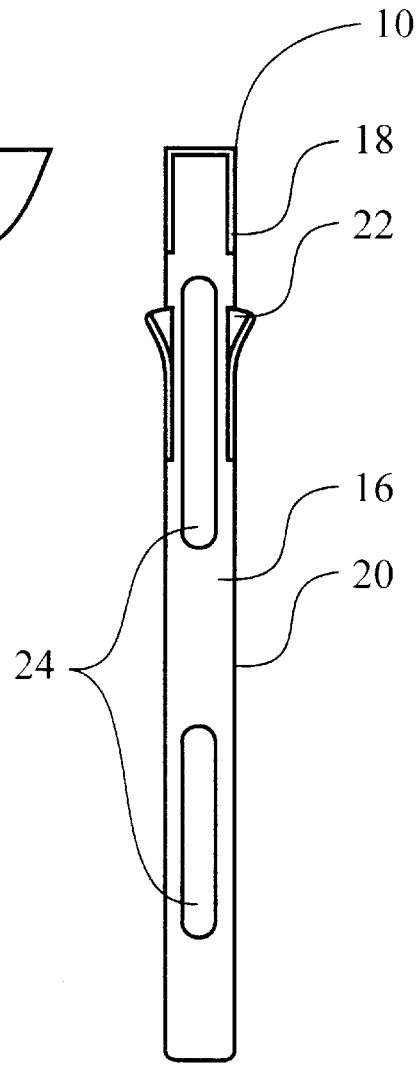
FIG. 1*b*, in a front view, illustrates the sliding catch of FIG. 1*a;*
Figure 2:
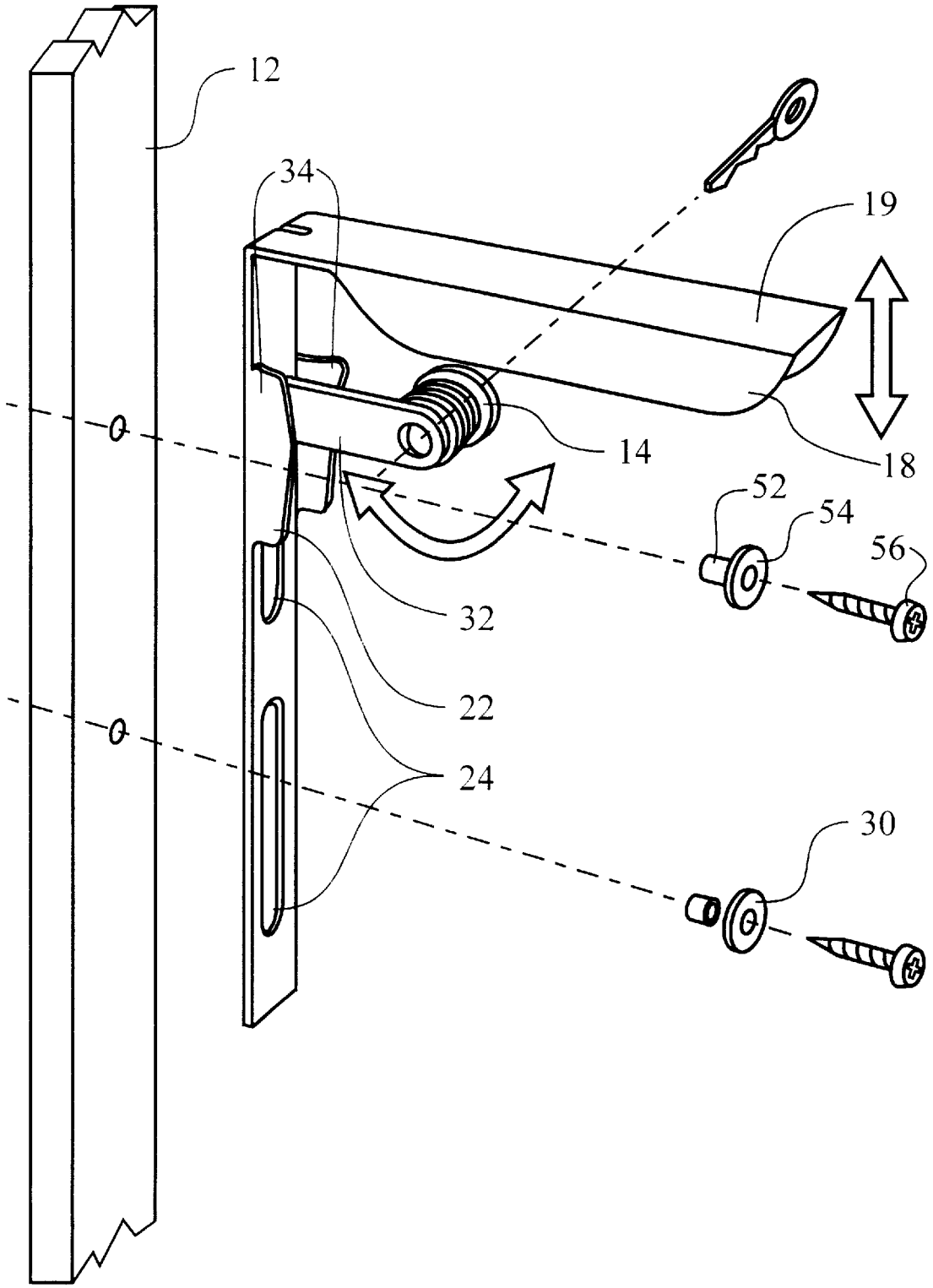
FIG. 2, in a exploded view, illustrates the mounting of the sliding catch and the location of the locking mechanism of the fire extinguisher cabinet.

Referring to FIGS. 1*a*–1*b,* there is illustrated a sliding catch in accordance with the preferred embodiment of the present invention. The sliding catch 10 with a partition release assembly for a fire extinguisher cabinet 12 has a locking mechanism 14, comprising of a L-shaped member 16 having a first portion 18 and a second portion 20.

Figure 3A:
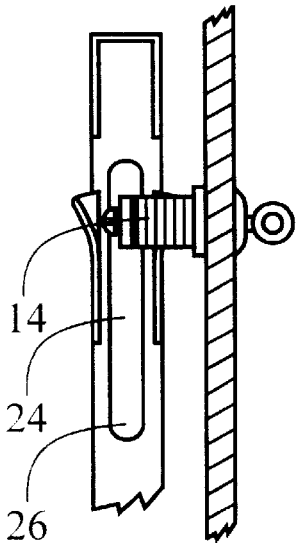
FIG. 3*a*, in a cross-sectional side view, illustrates the sliding catch in the first locked position.
Figure 3B:
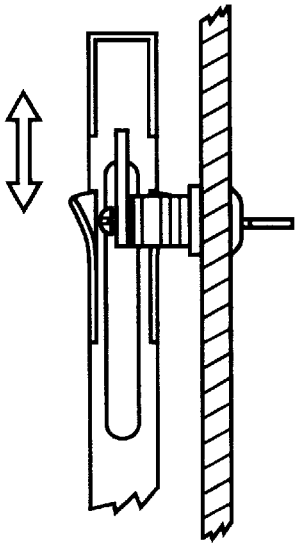
FIG. 3*b*, in a cross-sectional side view, illustrates the sliding catch with the locking mechanism in the an unlocked position.
Figure 3C:
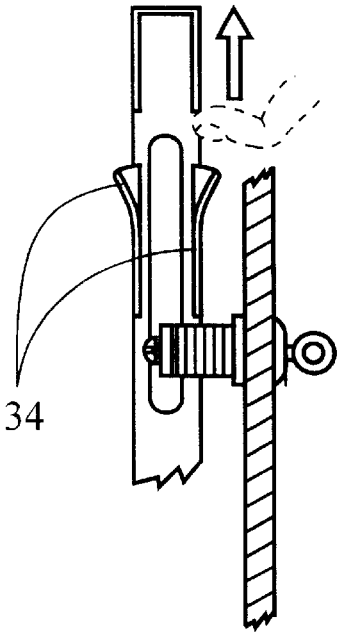
FIG. 3*c*, in a cross-sectional side view, illustrates the sliding catch being moved to a second unlocked position.
Figure 3D:
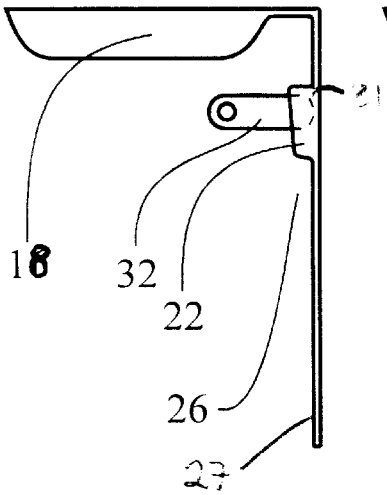
FIG. 3*d*, in a front view, illustrates the sliding catch and the locking mechanism in the first locked position.
Figure 3E:
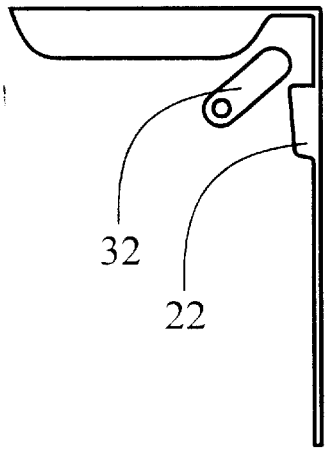
FIG. 3*e*, in a front view, illustrates the sliding catch and the locking mechanism when the siding mechanism is in an unlocked position.
Figure 3F:
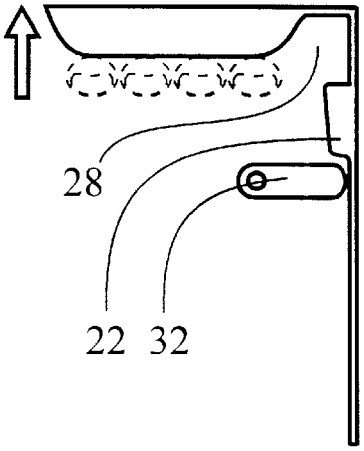
FIG. 3*f*, in a front view, illustrates the sliding catch and the locking mechanism when the sliding mechanism is moved to a second unlocked position.
Figure 4:
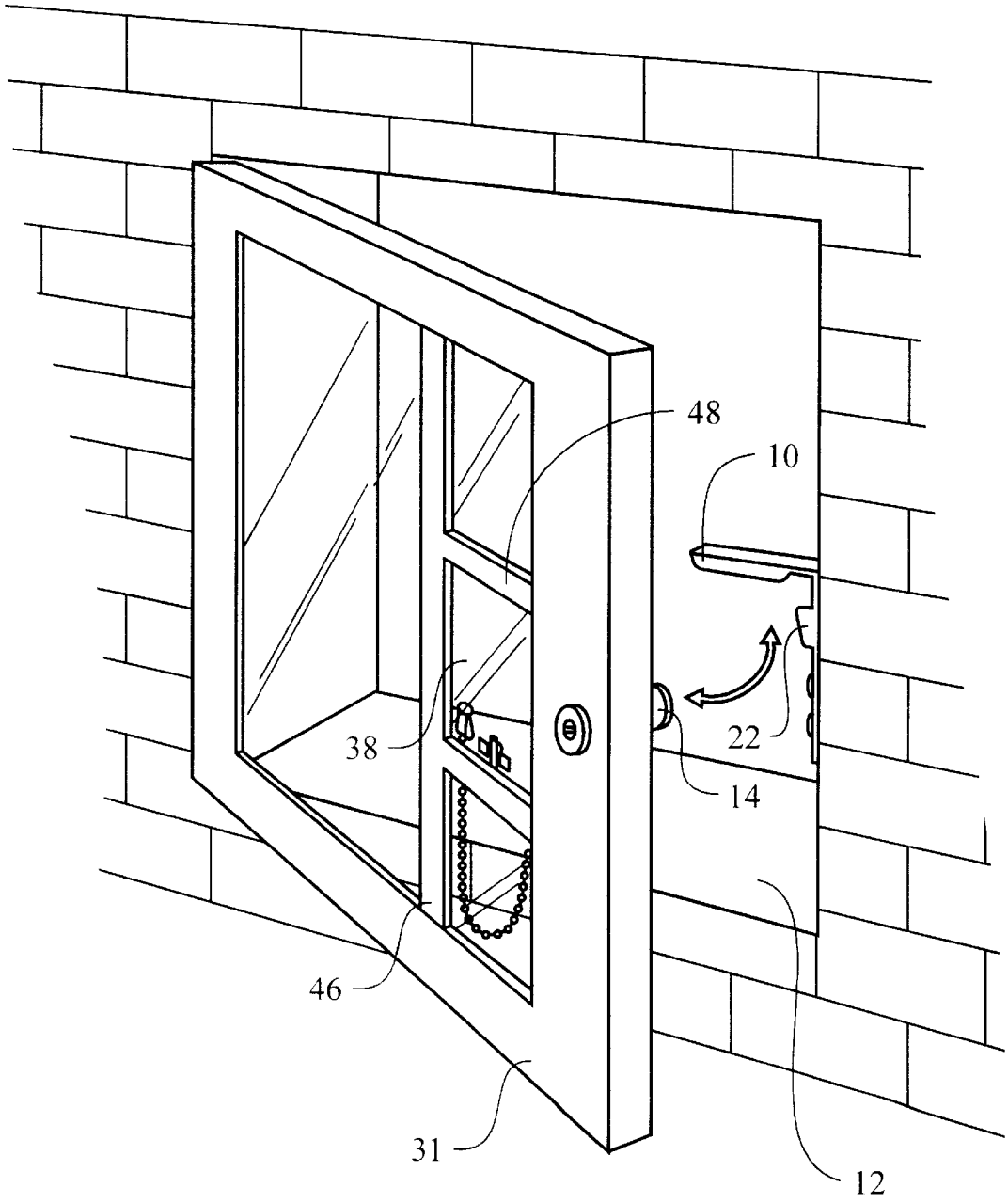
FIG. 4, in a perspective view, illustrates the sliding catch in operation with the fire extinguisher cabinet and locking mechanism.

Referring to FIGS. 2, 3*a*–3*f,* and 4, the second portion 20 may further comprise of a stopping means 22 and a slotting means 24. The slotting means 24 and therefore the L-shaped member 16 may be moved between a first locked position 26 to a second unlocked position 28 by a user lifting or pulling on the first portion 18 so that the stopping means 22 moves beyond the locking mechanism 14 (as best seen in FIG. 3*f*). The first portion 18 may be further defined as a handle member 19.

The sliding catch 10 may be mounted to the fire extinguisher cabinet 12 at the second portion 20 by a fastening means 30. The fastening means 30 may further comprise of a bushing 52, a washer 54 and a screw 56 or other similar fastener. The fastening means 30 may be mounted through the slotting means 24 to the fire extinguisher cabinet 12 in such a way that the sliding catch 10 is adhered to the fire extinguisher cabinet 12, but still allows for the sliding catch 10, and more specifically the slotting means 24 to move in an upward and downward motion against the fastening means 30.

Specifically, the sliding catch 10 may move the distance of the slotting means 24 without detaching from the fire extinguisher cabinet 12 as the bushing 52 of the fastening means 30 provides the clearance between the sliding catch 10 and the fire extinguisher cabinet 12. The bushing 52 also allows for the fastening means 30 to be tightened to a degree of tightness that allows the sliding catch 10 to move, but not detach from the fire extinguisher cabinet 12.

The stopping means 22 cooperates with the locking mechanism 14 when the sliding catch 10 is in the first locked position 26 thereby locking the door 31 of the fire extinguisher cabinet 12. The stopping means 22 may be further defined as parallel flanges 34 that allow the locking mechanism 14 to slide in between the parallel flanges 34 when the locking mechanism 14 is in the first locked position 26. Furthermore, the upper ends of the parallel flanges 34 are flared outwardly away from each other so as to assist in guiding the locking mechanism 14 between the parallel flanges 34.

More specifically, the locking mechanism 14 may be further defined as a key lock that can move a lock bar 32 between the parallel flanges 34 of the stopping means 22 from a first locked position 26 to a second unlocked position 28.

Figure 5A:
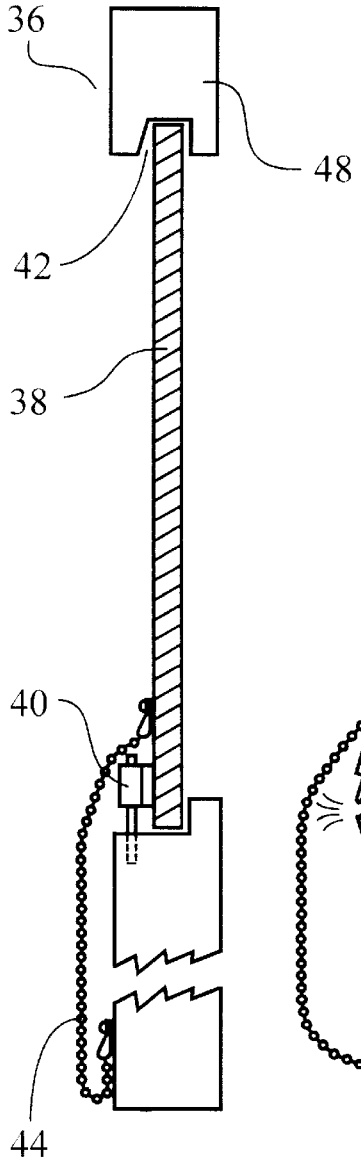
FIG. 5*a*, in a side view, illustrates the partition release assembly in a first resting position.
Figure 5B:
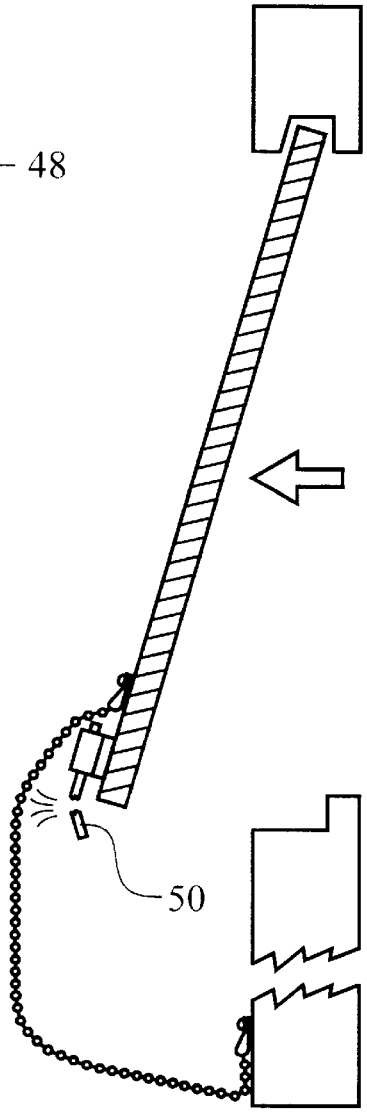
FIG. 5*b*, in a side view, illustrates the partition release assembly moving to a second released position.
Figure 5C:
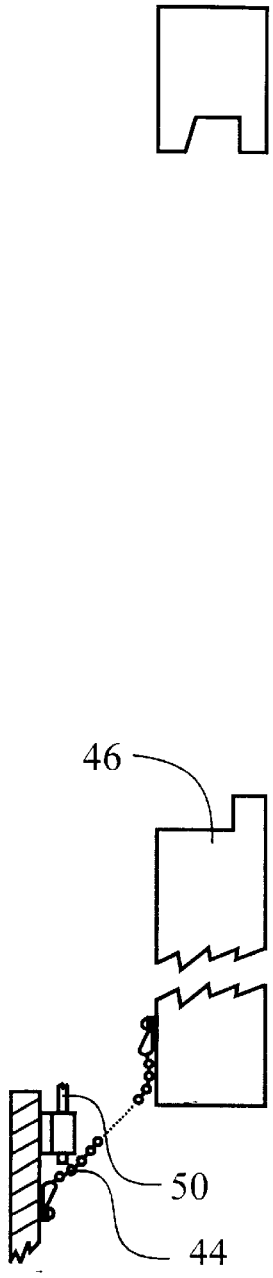
FIG. 5*c*, in a side view, illustrates the partition release assembly in a second released position.
Figure 6:
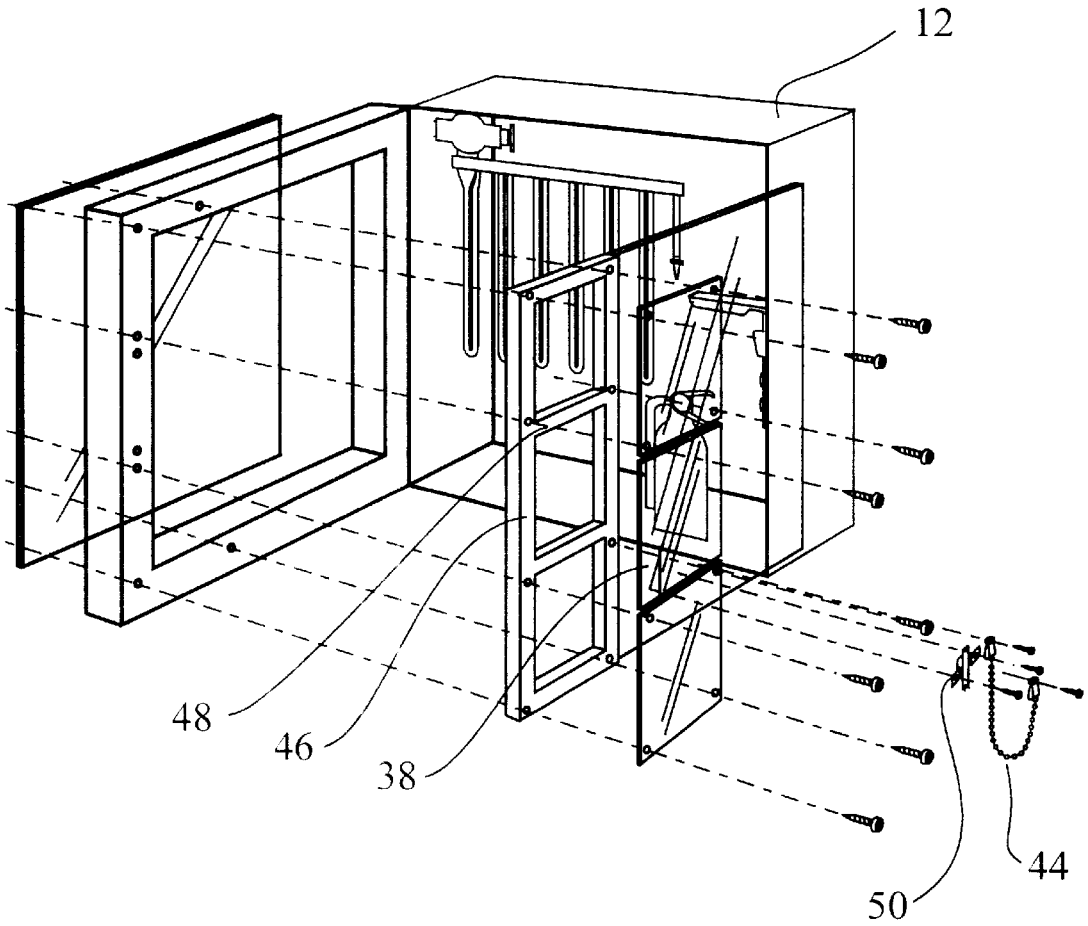
FIG. 6, in an exploded view, illustrates the assembly of the fire extinguisher cabinet.

Referring to FIGS. 5 and 6, the partition release assembly 36 includes a partition 38, an indicator means 40, an angled release groove 42 and a cable 44. The door 31 of the fire extinguisher cabinet 12 may consist of a framework 46 having at least one edge 48 that contains an angled release groove 42. The framework 46 may accommodate a number of partitions 38. A partition 38 can be mounted in the framework 46 such that the partition 38 rests in the edge 48 that contains the angled release groove 42. The partition 38 may be held securely in the framework 46 by an indicating means 40 such as a frangible pin 50. The pin 50 may be made from plexi-glass or glass that will break when pressure is exerted on the partition 38. A cable 44 may have one end attached to the partition 38 and the other end attached to the framework 46 so as to retrieve the partition 38 once the indicator means 40 has been broken. The sliding catch 10 may be made from metal products, preferably aluminum or aluminum alloy to provide strength in the first portion 18.

In operation, the fire extinguisher cabinet 12 is located in a hall-way of a building and is locked by a locking mechanism 14 such as a key lock with a lock bar 32. In an emergency, a user such as a fire-person, would push or pull against the partition 38, applying enough pressure to cause the indicator means 40 or pin 50 to break. There is a space between the partition 38 and the framework 46 to allow the user to push. The partition 38 would then be released from the framework 46 of the door 31 of the fire extinguisher cabinet 12 and would fall only to the length of the cable 44 that is attached to both the partition 38 and the framework 46. The fire-person would then be able to reach in and access the sliding catch 10 without risking any injury from the partition 38.

The fire-person can then grasp the handle member 19 of the first portion 18 and lift the sliding catch 10 from the first locked position 26, so that the stopping means 22, and more specifically the parallel flanges 34 slide pass the locking mechanism 14 or lock bar 32 to a second unlocked position 28. The fire-person may then open the door 31 of the fire extinguisher cabinet 12 and access the fire extinguisher equipment since the bar 32 is spaced from the second portion 20. In other words, edge 31 of bar 20 is at all times spaced from surface 27 of second portion 20. Upon completion of the use of the fire extinguisher equipment, the partition 38 may be re-installed into the angled-release groove 42 and secured by the replacement of only the indicator means 40 or pin 50, thereby saving in replacement costs of the partitions 38 and avoiding injury.

The user or fire-person may also use the key to the locking mechanism 14 to unlock the door 31 by moving the lock bar 32 to the unlocked position 28 from between the parallel flanges 34, as shown in FIGS. 3*b* and 3*e*.

Various embodiments of the invention have now been described in detail. Since changes in and/or additions to the above-described best mode may be made without departing from the nature, spirit or scope of the invention, the invention is not to be limited to said details.

I claim:

1. A sliding catch with a partition release assembly for a fire extinguisher cabinet having a locking mechanism, comprising an L-shaped member having a first portion and a second portion, said second portion further comprising parallel flanges and a series of slots; wherein said partition release assembly bars access to said sliding catch; said locking mechanism disposed between said parallel flanges in a first locked position; said series of slots moving from said first locked position to a second unlocked position by displacing said first portion wherein said stopping means moves beyond said locking mechanism.

2. A sliding catch as claimed in claim 1 wherein said partition release assembly comprises at least one partition, an indicating means, an angled release groove and a cable.

3. A sliding catch as claimed in claim 2 wherein said first portion is a handle.

4. A sliding catch as claimed in claim 1 wherein said partition rests within said angled release groove.

5. A sliding catch as claimed 4, wherein said indicating means is a pin, wherein said pin secures said partition within said angled release groove.

6. A sliding catch as claimed in claim 5 wherein said pin is plexi-glass or glass.

7. A sliding catch as claimed in claim 5 wherein said cable is adapted to secure partition to said fire extinguisher cabinet.

8. A sliding catch as claimed in claim 1 wherein said sliding catch is made from an aluminum metal product.

9. A sliding catch as claimed in claim 1, further comprising a fastening means for the sliding of said series of slots from said first locked position to said second unlocked position.

10. A sliding catch as claimed in claim 1 wherein said fastening means is a bushing, a washer and a fastener whereby said bushing allows for the sliding of said series of slots.

11. A method of operating a sliding catch with a partition release assembly for a fire extinguisher cabinet having a locking means comprising: moving an L-shaped member, having a handle and a second portion wherein said second portion further comprises a stopping means, a series of slots, a bushing, a washer and a fastener whereby said bushing allows for the sliding of said series of slots from a first locked position wherein said locking mechanism is disposed within said stopping means, to a second unlocked position by displacing said handle wherein said stopping means moves beyond said locking mechanism.

12. A method of operating a sliding catch as claimed in claim 11 wherein said stopping means further comprises parallel flanges wherein said locking mechanism rests in between said parallel flanges in said first locked position.

13. A method of operating a sliding catch as claimed in claim 12 wherein said partition release assembly comprises at least one partition, an indicating means, an angled release groove and a cable.

14. A method of operating a sliding catch as claimed in claim 13 wherein said fire extinguisher cabinet further comprises a framework having at least one edge, said edge having said angled release groove wherein said partition rests securely within said angled release groove by said indicating means.

15. A method of operating a sliding catch as claimed in claim 14 wherein said indicating means is a glass pin.

16. A method of operating a sliding catch as claimed 11 wherein said sliding catch is made from an aluminum metal product.

* * * * *